US005936520A

United States Patent [19]

Luitje et al.

[11] Patent Number: 5,936,520

[45] Date of Patent: Aug. 10, 1999

[54] ANALOG SENSOR STATUS DETECTION SINGLE WIRE BUS MULTIPLEX SYSTEM

[75] Inventors: William V. Luitje, Ann Arbor; Frederick O. Miesterfeld, Troy; Thomas R. Wroblewski, South Lyon, all of Mich.

[73] Assignee: Chrysler Corporation, Auburn Hills, Mich.

[21] Appl. No.: 08/970,022

[22] Filed: Nov. 13, 1997

[51] Int. Cl.[6] ..... G08B 23/00

[52] U.S. Cl. ..... 340/517; 340/505; 340/538; 340/825.06; 340/511; 364/139

[58] Field of Search ..... 340/517, 505, 340/538, 825.07–825.13, 825.54, 511, 510, 825.06; 364/138, 139, 140, 141

[56] References Cited

U.S. PATENT DOCUMENTS

| | | | |
|---|---|---|---|
| 4,394,655 | 7/1983 | Wynne et al. | 340/505 |
| 4,603,318 | 7/1986 | Philp | 340/505 |
| 4,727,359 | 2/1988 | Yuchi et al. | 340/505 |
| 4,785,285 | 11/1988 | Teich et al. | 340/505 |
| 4,796,025 | 1/1989 | Farley et al. | 340/825.36 |
| 5,117,219 | 5/1992 | Tice et al. | 340/518 |
| 5,227,763 | 7/1993 | Kikuchi | 340/505 |

*Primary Examiner*—Donnie L. Crosland
*Attorney, Agent, or Firm*—Roland A. Fuller III

[57] ABSTRACT

A circuit monitors both digital and analog sensor readings by polling them from a single wire bus multiplex system. The circuit operates to sequentially address a plurality of smart sensor interfaces, each having an associated sensor, connected to the single wire bus. A voltage signal is supplied on the line that produces a current corresponding to the presence of a sensor at the polled interface and a current corresponding to a sensed digital or analog value where the sensor is of the digital or analog type, respectively. The currents on the bus are copied in a current mirror whose current output is applied to a resistor to produce a voltage, which in turn is converted into a digital number to be analyzed to determine the presence of a sensor at the addressed interface and its status. The current in the circuit is also measured to produce a voltage corresponding to circuit component variations and one corresponding to the contributions of the currents from the power supplies of the interfaces. These voltages correct the calculation of the voltage corresponding to the sensor analog value.

17 Claims, 4 Drawing Sheets

A - INITIAL VOLTAGE REPRESENTING SENSOR QUIESCENT CURRENT
B - SENSOR PRESENT
D - SENSOR PRESENT
F - SENSOR PRESENT
H - NO SENSOR PRESENT
I - SENSOR PRESENT
K - NO SENSOR PRESENT
L - SENSOR PRESENT
N - SENSOR PRESENT
P - NO SENSOR PRESENT

C - SENSOR NOT ACTIVE
E - SENSOR ACTIVE
G - SENSOR TRANSMITS ACTIVE VALUE
J - SENSOR NOT ACTIVE

M - SENSOR ACTIVE
O - SENSOR ACTIVE

ANALOG SENSOR STATUS DETECTION SINGLE WIRE BUS MULTIPLEX SYSTEM

FIELD OF THE INVENTION

This invention relates to a multiplexing system for determining the status of a plurality of devices disposed along and connected to a single wire bus line and, more particularly, to a system for remotely monitoring the status of sensors, including analog sensors, associated with such devices by the polling of the sensors over a single wire bus multiplex system.

DESCRIPTION OF RELATED ART

A switch status monitoring system is described in U.S. Pat. No. 4,677,308 of Thomas R. Wroblewski and Frederick O. R. Miesterfeld entitled "Switch Status Monitoring System, Single Wire Bus, Smart Sensor Interface Arrangement Therefor". In the system of that patent the "on" or "off" status of a switch, which essentially is a digital sensor, associated with each of a plurality of devices is monitored by multiple addressing of each sensor respectively associated with each such device over a bus line. A similar system is also described in U.S. Pat. No. 4,736,367 of Thomas R. Wroblewski and Frederick O. R. Miesterfeld entitled "Smart Control and Sensor Devices Single Wire Bus Multiplex System". The contents of both patents, which are both assigned to the assignee of this application, are incorporated herein by reference.

The assignee of the subject application, in 1988 also published a manual entitled "CSC Bus User's Manual" (revised Feb. 3, 1994) that describes a system currently in use in which different types of on-off switch type sensors are located at various places in a vehicle, e.g., a window switch control, a horn switch, etc. All of the sensors are connected via respective interfaces to a single wire bus line and a multiplex operation periodically selectively addresses, or polls, the sensor interfaces. Information in the form of a digital code corresponding to the on/off status of the switch is read out from each sensor interface and is received at a system controller. Each sensor interface has its own address so that the system controller can readily match the digital code with the data read out from the associated switch. The received information on switch status can be used to operate various devices, such as motors, or it can be displayed.

The above-described single wire bus system monitors switch type sensors that represent only on/off status, which can be represented by a digital 1 or 0. The systems of the aforesaid patents cannot handle status readings from analog type sensors over the single bus line, e.g. sensors that monitor variable parameters of devices such as liquid level gauges, temperature indicators, etc. Conventionally, such monitoring of analog type sensors requires a dedicated line for each analog sensor to determine its status value. It would therefore be desirable to monitor the status of analog type sensors over a single wire, and preferably the same single wire bus multiplex system used for sensing switch type (digital) sensors, so that a mix of on/off switch and analog type sensors can be monitored on the same line. Such a system obviates the need for a separate dedicated line to handle monitoring of the data output of each analog type sensor. The reduction in the number of wire lines is of particular advantage in automobiles.

SUMMARY OF THE INVENTION

The present invention is directed to a multiplex system for monitoring output readings of a plurality of sensors arranged arbitrarily along a single bus wire. The multiplex system can contain sensors of the analog type which measure continuously variable parameters, e.g. temperature, fluid level, pressure, etc.

The general arrangement of the multiplex system is to have the analog sensor elements interfaced to the bus wire via smart sensor interface circuits and a microprocessor which communicates with the smart sensor interfaces by means of a specially designed driver/receiver circuit. The driver/receiver circuit issues commands to the smart sensor interfaces, each of which has a unique address code built into it, by means of signals of different voltage levels. The smart sensor interfaces communicate their status and the state of their associated sensors by drawing a current when addressed.

The microprocessor is able to measure the magnitude of these currents without distorting them because the driver/receiver circuit has built into it a current mirror device which produces an amplified copy of any current which flows through it. The microprocessor, which has an associated analog to digital converter, measures this amplified copy of the bus current by measuring the voltage drop across a conversion resistor. The microprocessor controls the operation of the multiplex bus by issuing a series of commands in the form of specific voltage levels on the multiplex bus wire. The commands consist of a reset command, an initialize command and an increment address command as well as a read sensor command for each possible sensor in the system The system overcomes manufacturing variations in the various circuit elements and variations in system configuration which possibly may introduce significant errors into the measured value of the sensor status. The present invention removes these inaccuracies by using a few precision resistors placed in the system at appropriate places and by making additional measurements and computations based on the currents flowing through these resistors.

OBJECTS OF THE INVENTION

It is therefore an object of the present invention to provide a system for individually monitoring a plurality of sensors, including at least one analog type sensor, over a single wire bus line.

Another object is to provide a single wire bus line multiplex system over which a plurality of sensors, including at least one analog type sensor, can be individually polled and status data acquired for each.

Yet a further object is to provide a single wire bus line system to which at least one analog type sensor is connected and whose data status is monitored, which system includes a circuit for minimizing possible measuring errors introduced by certain of the system components.

An additional object is to provide a single wire bus line multiplex system to which a plurality of smart sensor interfaces are connected. Each of the interfaces has an associated sensor, including at least one with an analog type sensor. The interfaces are individually addressed and polled, and status data for the associated sensor is obtained in the form of current drawn by the device with which the analog sensor is associated. The data is converted into a digital value for processing.

BRIEF DESCRIPTION OF THE DRAWINGS

Other objects and advantages of the present invention will become more apparent upon reference to the following specification and annexed drawings in which.

DESCRIPTION OF THE PREFERRED EMBODIMENT

Figure 1:
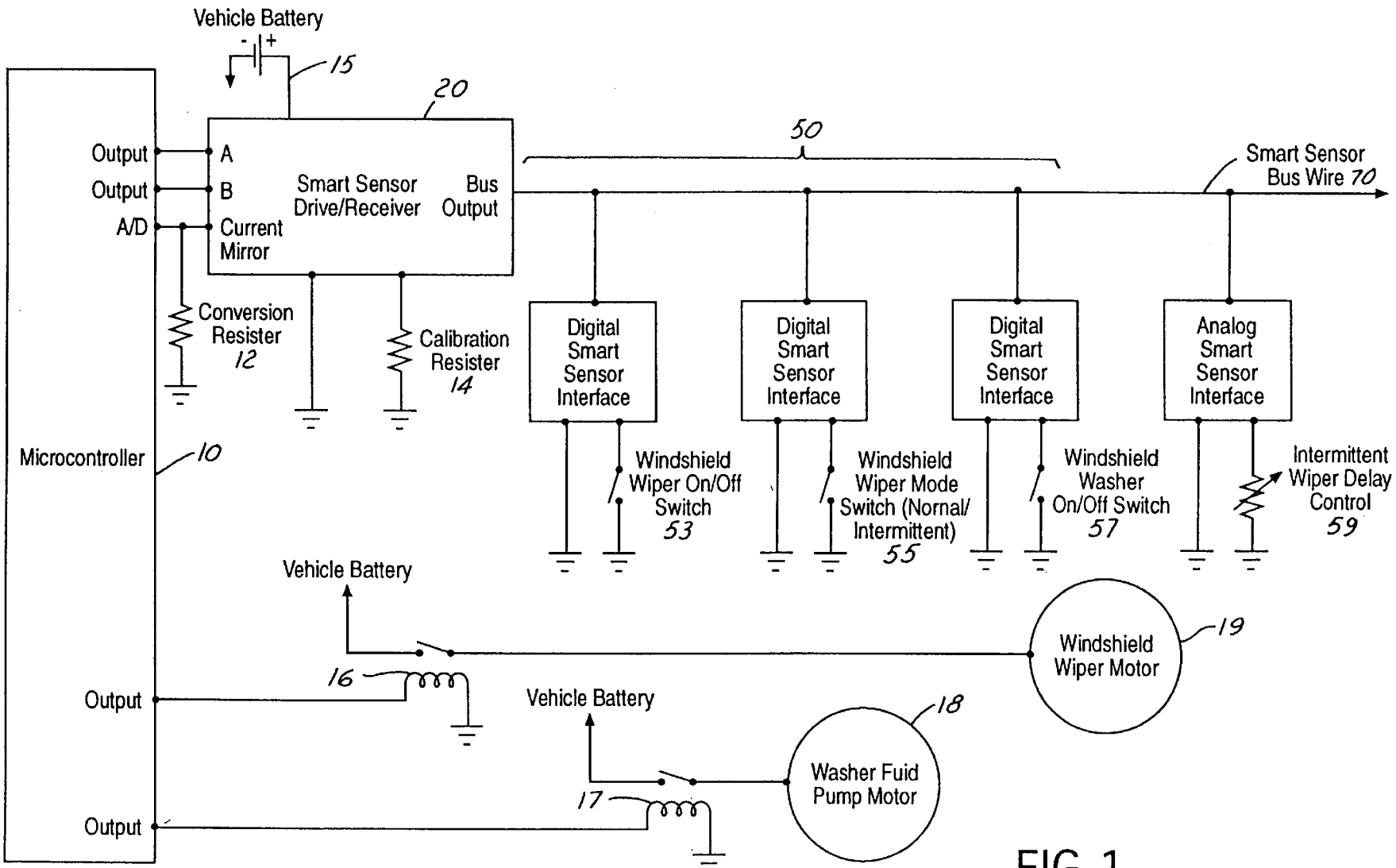
FIG. 1 is a schematic diagram of the system illustratively implemented for multiplex monitoring of digital and analog sensors.

FIG. 1 is an overall system diagram according to the invention. For illustration, an automobile windshield wiper control system is shown, but the invention can be used in other applications. The system includes a microcontroller 10 which is a conventional microprocessor with associated CPU, ROM memory containing a stored control program and a look-up table, RAM memory for storage of variables and intermediate results, an analog/digital converter, input and output ports, timer circuits and conventional computing and control portions. The microcontroller has output ports, as shown, and an analog/digital (A/D) input port.

Two of the microcontroller output ports are connected to inputs A and B of a bi-directional smart sensor interface Driver/Receiver (D/R) integrated circuit 20, which is described in detail below. The D/R 20 receives operating voltage from a battery 15, which would be the vehicle battery in the illustrative application. Two resistors, 12 and 14, whose values are accurately known, are provided. Resistor 12 is a conversion resistor connected to a current mirror circuit in the D/R 20 and is used to convert a current to a voltage to be applied to the A/D converter of the microcontroller 10. Resistor 14 is used for calibration purposes, as described below.

The D/R 20 has a bus output to which is connected a single conductor bus line 70. In the automobile application being described, the single line 70 is a wire of suitable gauge that runs though the various parts of the automobile, as needed. A plurality of digital smart sensor interface integrated circuits 50, which are described in detail in the previously referenced patents, each has an input connected to the common bus line 70. Three such digital interface circuits 52, 54 and 56 are illustratively shown, although more can be used as needed. A respective digital, i.e. on-off, sensor device is connected to each digital smart sensor interface. For example, a windshield wiper on-off switch 53 is connected to interface 52, a windshield wiper normal-intermittent mode switch 55 is connected to interface 54 and a windshield washer on-off switch 57 is connected to interface 56.

One or more analog smart sensor interface integrated circuits 60, which are described in detail below, also are connected to the single common bus line 70. Each interface circuit 60 is associated with an analog measuring device. Illustratively, a variable resistor 69 for the windshield wiper delay control is shown by which the user sets the rate of wiper operation for the wiper when in its intermittent operation mode as set by switch 55. Other analog devices can be, for example, liquid level sensors, pressures sensors, etc. The analog sensors of different types all have the common characteristic of producing a current component on the bus line corresponding to the sensor being present and its status, i.e., the value of the parameter being sensed, upon the sensor being polled by a voltage.

Conventional relays 16 and 17 also are connected to output ports of the microcontroller 10. Relay 16 illustratively operates a normally open contact in series between the vehicle battery 15 and a windshield washer motor 19 while relay 17 illustratively operates a normally open contact in series with the vehicle battery and a windshield washer fluid pump motor 18. Any suitable number of relays for controlling various motor, lights, warning devices and other similar devices can be utilized as desired. When microcontroller 10 sends an output signal to one of the relays 16 or 17, the corresponding relay contact is closed and voltage is applied to operate the connected motor.

The overall operation of the system is as follows. Microcontroller 10 continuously sends addressing signals via D/R 20 over bus line 70 to the connected smart sensor interfaces 50 and 60. D/R 20 also continuously monitors the response of the smart sensor interfaces 50 and 60 over line 70. Each of the smart sensor interfaces has a pre-programmed address and address decoding circuitry so that their order and location along bus wire 70 is immaterial to the operation of the system. If, for example, the driver closes windshield wiper on/off switch 53 while the normal/intermittent mode switch 55 is in normal (continuous wiping) mode, the microcontroller 10 will detect this request and operate relay 16 to turn on wiper motor 19 for continuous operation. If on/off switch 53 is in the on position and mode switch 55 is in the intermittent position, microcontroller 10 will detect this, then turn on wiper motor 19 via relay 16, then turn off the motor after a single wipe, wait for an amount of time which is controlled by the intermittent wiper delay resistor 69 as set by the user before wiper motor 19 is turned on again.

Figure 2:
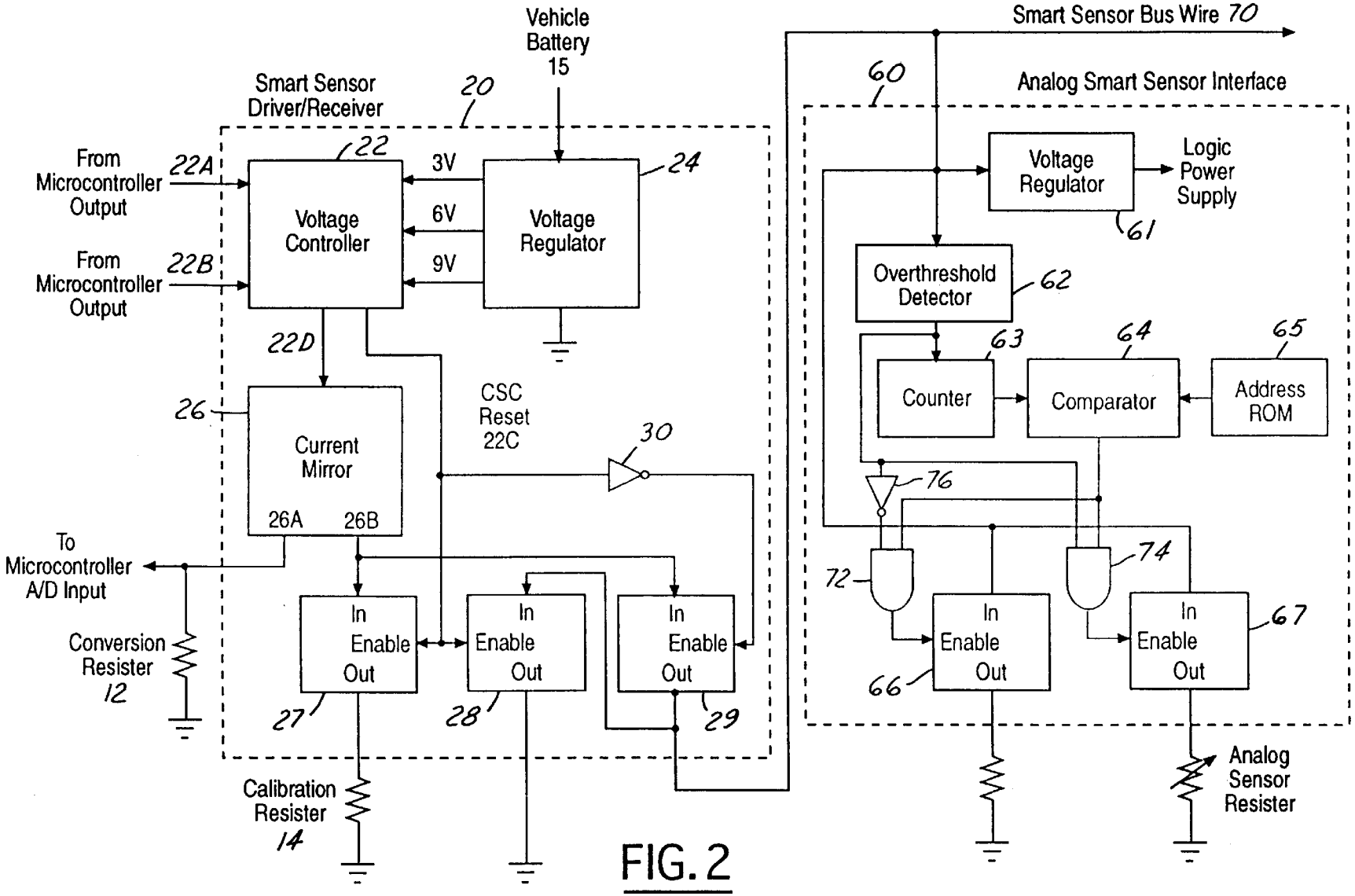
FIG. 2 is a circuit block diagram of the driver/receiver and a smart sensor interface for an analog type sensor of the system of FIG. 1.
Figure 3:
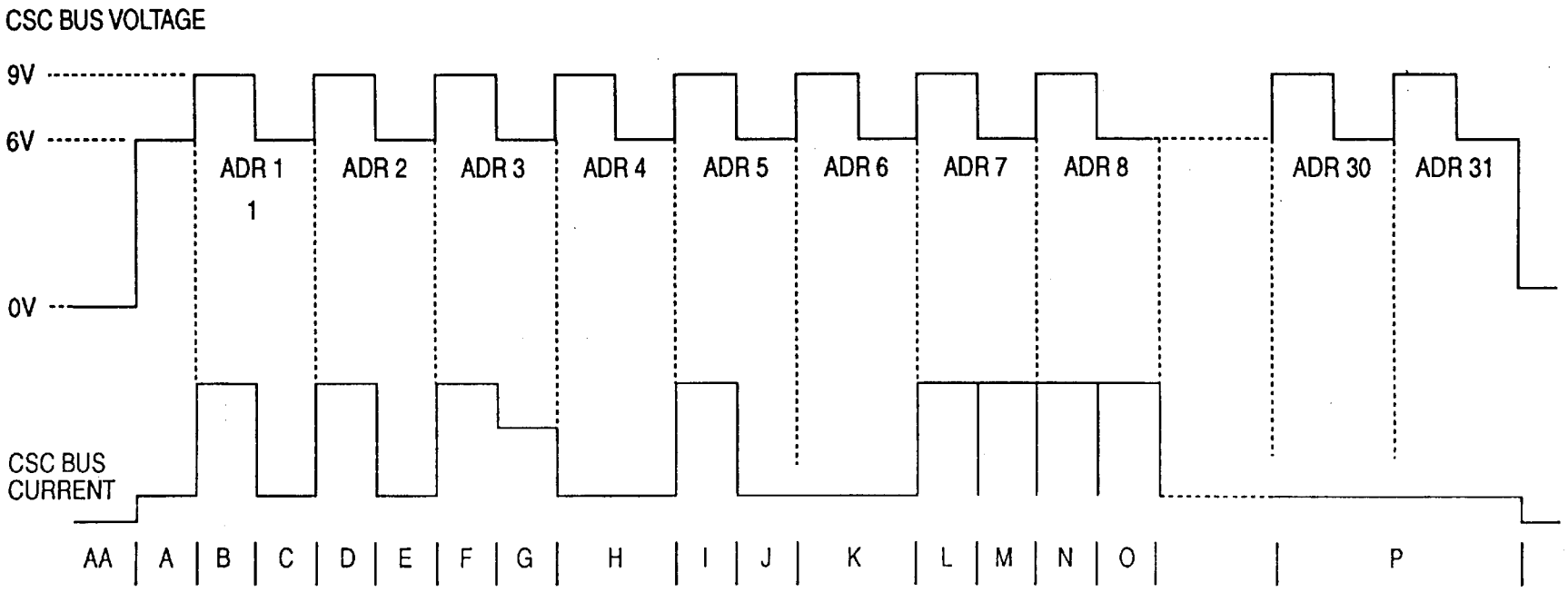
FIG. 3 is a diagram illustrating voltage and current waveforms present on the bus wire during operation of the multiplex system.

Referring to FIGS. 2 and 3, the detailed operation of the multiplex system will now be described. FIG. 2 shows the major components of the multiplex system, except for the microcontroller 10. These are driver/receiver 20, an analog smart sensor interface 60 and the single bus wire 70. The interface for the digital sensor is not shown in detail and is similar to the analog interface. It also is described in the aforesaid patents. The system needs only a single bus wire 70 in an automobile application since the current return is through the vehicle metal chassis. If the invention is to be used in an application which does not have a conducting metal frame, then a second wire will be required. Bus wire 70 is an ordinary electrical conductor with a gauge and insulation suitable for its intended usage environment and need not be discussed further.

Microcontroller 10 controls D/R 20 to send signals of varying voltage to the various smart sensor interfaces 50 and 60. The signals comprise patterns of different voltages which are repeated in major and minor cycles. The minor cycles serve to address and read information from each smart sensor interface 50, 60 and the major cycles serve to poll all of the smart sensor interfaces operating in the multiplex system.

When an individual smart sensor interface 50 or 60 is addressed, it responds by drawing currents which indicate both its own state, i.e., whether it is present with an associated sensor and operational or not, and the state of its associated switch or analog sensor. D/R 20 converts the current drawn by each interface circuit 50, 60 across resistor 14 into a voltage which is digitized by the A/D converter of microcontroller 10. The converted digital information is processed by the microcontroller to recover this state information from each sensor connected to the multiplex bus.

The upper line I of FIG. 3 shows the signal voltage produced by D/R 20 as a function of time transmitted on the bus wire 70 to the smart sensor interfaces 50, 60 under control of microcontroller 10. The bottom line II shows the return current flowing through bus wire 70 produced by sensing of the various sensors as a function of time. Various points in time are indicated by the letters below line II. In this embodiment, three voltages are used to control and monitor the smart sensor interfaces. A voltage near zero is a "bus reset command" which causes each of the smart sensor interfaces 50, 60 to clear its address counter to 0 and disconnect its sensor from the bus circuit. A voltage of 9V is an "increment address command" which causes each smart sensor interface to increment its address counter. A voltage of 6V is a "read sensor command" which causes the currently addressed smart sensor interface to connect its sensor, e.g. on-off switch or resistor, to the multiplex bus circuit.

A minor cycle consists of an "increment address command" (9V bus voltage) and a "read sensor command" (6V bus voltage). A major cycle consists of a "bus reset command" (0V bus voltage), a 6V bus voltage level which in this case serves to activate all of the smart sensor interface interfaces, but not to read a sensor since none of the smart sensor interfaces is addressed at this time, and then a minor cycle for each possible smart sensor interface in the system. In the embodiment of the invention being described, smart sensor interface addresses are shown from 1 to 31 so there would be 31 minor cycles. Since there may be many smart sensor interfaces on the bus wire, each command must last long enough to ensure that any of the smart sensor interfaces can respond in the time allotted. In the preferred embodiment, each of the commands has a duration of 500 microseconds and a minor cycle is twice as long, i.e. one millisecond.

Referring again to FIG. 2, the detailed operation of the D/R 20, which contains the components necessary to produce the waveforms of FIG. 3, is described. Driver/Receiver 20 has four major components. There is a conventional voltage regulator 24 which takes nominal 12V power from vehicle battery 15 and produces regulated voltages of 9V, 6V and 3V. Regulator 24 supplies the voltages to a voltage controller 22 which, depending on signals produced by microcontroller 10 and applied to the voltage controller 20 inputs 22A and 22B, supplies a 6V or 9V power source from its output 22D to a conventional current mirror circuit 26 and also produces a control signal CSC Reset 22C that is applied to transmission gates 27, 28 and 29. The outputs from voltage controller 22 as a function of the input signals from the microcontroller to the voltage controller inputs 22A and 22B are shown in Table 1. As seen, when the input signal on terminal 22A is logic 0 and on terminal 22B is logic 1 a voltage of 6V is applied to bus wire 70 and signal CSC Reset 22C is logic 0, while if 22A and 22B are both at logic 0, a voltage of 6V is available to be applied through the current mirror 26 to the bus wire 70 and signal CSC Reset 22C is logic 1.

TABLE 1

| 22A | 22B | VOLTAGE OUTPUT | CSC RESET |
|---|---|---|---|
| 0 | 0 | 6 | 1 |
| 0 | 1 | 6 | 0 |
| 1 | 0 | 3 | 0 |
| 1 | 1 | 9 | 0 |

Current mirror 26 of the D/R 20 takes the voltages routed to it through voltage controller 22 terminal 22D and uses them in two circuits via terminals 26A and 26B. A current mirror is a standard analog circuit which uses the current flowing through one of its branches to control the current through another of its branches. Here, as described below, the current mirror 26 produces an amplified copy of the current flowing through the bus wire 70 that is returned from the sensors upon being polled. The bus wire 70 current obtained from the analog and digital sensors flows through current mirror terminal 26B and the copied current flows through terminal 26A. This copied current is converted into a voltage by passing it through conversion resistor 12 without disturbing the current flowing through the bus circuit. This voltage can be easily measured by microcontroller 10 and converted into the units of the measurand, e.g. resistance of the device being monitored, fluid level, temperature,. etc., by means of internal calculations and look-up tables. The resultant of the look-up determines further action to possibly be taken by the microcontroller, such as producing a signal to turn one of the motors 18 and 19 on or off.

D/R 20 has transmission gates 27, 28 and 29 and a single inverter 30. The transmission gates are circuit elements which act as bidirectional semiconductor switches of low resistance which are controlled by a logic signal. These gates perform the task of switching the connection of bus wire 70 to either ground or to terminal 26B of the current mirror and either connecting or disconnecting external calibration resistor 14 to the output of the voltage controller 22 depending on the state of the signal CSC Reset 22C. When CSC Reset 22C is logic 0, the logic 0 is inverted by inverter 30 and turns on gate 29 so that the output of the voltage controller 22 is connected from current mirror output 26B to bus wire 70. Gates 28 and 29 are turned off and calibration resistor 14 is disconnected from the output 26B of the current mirror. When CSC Reset 22C is logic 1, the output 26B of the current mirror is applied through transmission gate 27 to calibration resistor 14 and the bus wire 70 is connected to ground through transmission gate 28.

There are several components external to D/R 20 which are associated with it. These include the conversion resistor 12. Since the signals returned from the smart sensor interfaces 50, 60 to D/R 20 are expressed as variations in current, the voltage drop of the current through conversion resistor 12 converts this current to a voltage which is readily measured by microcontroller 10. There also is the calibration resistor 14. Several parts of the circuit are subject to variability in manufacture to such an extent that measurements of the same signal with different components can give varying results. Calibration resistor 14 is a resistor of sufficient precision, e.g. 1%, such that microcontroller 10 can post process the measurements with the information gained by measuring the current flow through calibration resistor 14 to give acceptable accuracy.

The analog smart sensor interface 60 is also shown in FIG. 2. The interface 60 has a voltage regulator 61 which produces supply voltages for use by the logic circuitry of the interface. An overthreshold detector 62 detects the address (9V) pulses applied from D/R 20 over bus wire 70 during the first part of a minor cycle. Each address command causes a counter 63 to increment by one. The output of counter 63 is applied to one input of a comparator 64 whose other input is received from an address ROM 65 which is preprogrammed with a unique address for each sensor interface. The comparator 64 determines when the individual sensor interface is selected by the address as determined by the 9V pulses sent over bus line 70. In the preferred embodiment, sensor addresses are all less than 32 so 5 bit wide circuit elements can be used.

Counter 63 is set to zero during the 0 volt bus reset command (see FIG. 3) which starts the major cycle and increments by one each time the overthreshold detector 62 detects the receipt of an increment address command (9 volts). Address ROM 65 is a read only memory containing the address of the individual smart sensor interface. Each smart sensor interface in a given multiplex system has a unique numerical address assigned to it and programmed into its address ROM 65. The address ROM can be implemented in any convenient technology, e.g., transistor array, metal oxide semiconductor bit array, laser programmed switch array, or voltage programmable fusible links. Comparator 64 continuously compares the output of counter 63 with address ROM 65 and outputs a logic 1 when they are equal, that is, when the smart sensor interface has been addressed. Otherwise, the comparator outputs a logic zero (0).

Transmission gates 66 and 67 connect the bus wire 70 to either ground or the analog sensor resistor 69 when the analog smart sensor interface is addressed depending on whether the interface and its connected analog device is in the address or sense state. AND gates 72, 74 and an inverter 76 control transmission gates 66 and 67 based on the outputs of overthreshold detector 62 and comparator 64 as specified by Table 2 below. The output of the overthreshold detector 62 is applied through an inverter 76 to one input of a first AND gate 72 and directly to one input of a second AND gate 74. The other input of each AND gate 72 and 74 is connected to the output of comparator 64.

The external analog resistor 69 associated with analog smart sensor interface 60 can be a variable resistor mechanically linked to a physical parameter to be measured, such as a conventional automotive fuel tank float sensor, a thermistor, a cadmium-sulfide light sensor which varies its resistance directly in response to a change in a physical parameter, or it can be any other variable resistance system.

TABLE 2

| COMPARATOR | OVER-THRESHOLD | TRANSMISSION GATE 66 | TRANSMSSION GATE 67 |
|---|---|---|---|
| 0 | 0 or 1 | Disabled | Disabled |
| 1 | 1 | Enabled | Disabled |
| 1 | 0 | Disabled | Enabled |

A description of the operation of the system follows.

To begin a major cycle of multiplex bus operation the microcontroller 10 issues a bus reset command by placing logic 0s on input terminals 22A and 22B of the Driver/Receiver 20 for 500 microseconds. This is shown as time period AA in FIG. 3 during which the CSC Reset 22C is logic 1. D/R 20 causes 6V to be applied to current mirror 26, terminal 26B to be connected to calibration resistor 14 and bus wire 70 to be connected to ground via transmission gate 28. Connecting bus wire 70 to ground causes all smart sensor interfaces 50 and 60 in the system to reset all of their internal circuitry and counters. Current can now flow from terminal 26B of current mirror 26 through transmission gate 27 and calibration resistor 14. Current mirror 26 also causes an amplified copy of this current to flow through terminal 26A and conversion resistor 12. Approximately midway through this 500 microsecond period microcontroller 10 reads the voltage drop across conversion resistor 12 by means of its analog/digital converter and saves this number in a program variable called Vcal for later processing.

During time period A (see FIG. 3) microcontroller 10 issues a bus initialization command by applying a logic 0 on D/R input terminal 22A and a logic 1 on terminal 22B for 500 microseconds. The CSC Reset 22C is now logic 0. This causes transmission gate 27 to be off, thus disconnecting terminal 26B from calibration resistor 14. It also causes transmission gate 28 to be turned off, thus disconnecting bus wire 70 from ground, and transmission gate 29 to be turned on, thus connecting bus wire 70 to current mirror terminal 26B. During this period, power is applied to all of the smart sensor interfaces 50 and 60 via bus wire 70 and they initialize themselves. At approximately the midpoint of period A, microcontroller 10 reads the voltage drop across conversion resistor 12 and saves the number in a program variable called Vbase for later use.

Periods AA and A of FIG. 3 constitute the beginning of a major cycle of multiplex bus activity. Microcontroller 10 then performs a minor cycle of multiplex bus activity for each potential smart sensor interface which can be present on the bus. A minor cycle is made up of an increment address command (9V) and a read sensor command (6V), each for a period of 500 microseconds, and has a total period of one millisecond. The discussion below is directed to the first three minor cycles of the example illustrated in FIG. 3. The other minor cycles are accomplished in the same manner.

* During time periods B and C, the system performs the address and read, respectively, of the digital smart sensor interface 50 which has the address 1. In the example, the digital sensor of this interface is off.
* During time periods D and E, the system performs the address and read of the digital smart sensor interface which has the address 2. This sensor is on.
* During time periods F and G, the system performs the address and read of analog smart sensor interface 60 which has the address 3 in this example.

In the discussion below, operation of the analog smart sensor interface 60 is described. The operation of the digital smart sensor interfaces 60 is substantially the same with regard to addressing and sensor detection. The operation of these digital sensor devices is covered in the above referenced patents.

During time period B, microcontroller 10 operates D/R 20 to issue an increment address command of 9V on the multiplex bus 70 by asserting a logic 1 on both input terminals 22A and 22B of the voltage controller 22. The CSC Reset 22C is at logic 0 so transmission gates 27 and 28 do not change state, terminal 26B of current mirror 26 remains connected to bus wire 70, and calibration resistor 14 remains disconnected. The only difference is that voltage controller 22 routes 9V to current mirror 26 and hence out onto bus wire 70. In each smart sensor interface 50 and 60 attached to the data multiplex bus 70 the overthreshold detector 62 senses that an address pulse has been issued and causes the counter 63 of each interface to increment to 1. In this example, analog smart sensor interface 50 has the address 3 stored in its address ROM 65. At time period B, corresponding to addressing of smart sensor interface 1, comparator 64 of the non-addressed interface 3 outputs a logic 0, which disables transmission gates 66 and 67 of this interface, thus isolating analog sensor resistor 69 from bus wire 70.

In the digital smart sensor interface 50 whose address is 1, its comparator 64 will output a logic 1 and bus wire 70 will be connected to ground via transmission gate 66 of the digital smart sensor interface 50 causing electrical current to flow from current mirror 26. At approximately the middle of time period B microprocessor 10 uses its A/D converter to read the voltage drop across conversion resistor 12. If the voltage is high, then microcontroller 10 can deduce that digital smart sensor interface with address 1 is present on the multiplex bus 70 and functioning.

During time period C, microcontroller 10 issues a read sensor command of 6V on the multiplex bus 70 by asserting a logic 0 on terminal 22A and a logic 1 on terminal 22B of the voltage controller 22 for 500 microseconds. The CSC Reset 22C is logic 0 so that transmission gates 27 and 28 do not change state, terminal 26B of the current mirror 26 remains connected to bus wire 70, and calibration resistor 14 remains disconnected. The only difference is that the voltage controller 22 routes 6V to current mirror 26 and hence out onto bus wire 70. During this period the addressed digital smart sensor interface 50 connects bus wire 70 to its associated digital sensor switch by enabling its transmission gate 67. If the switch is open, only a small current will flow from current mirror 26 and hence a low voltage will be present across conversion resistor 12. If the switch is closed, a large current will flow from current mirror 26 and hence a high voltage will be present across conversion resistor 12. In this example the switch is open so microcontroller 10 reads a small voltage during time period C.

During time periods D and E a sequence of events similar to those during time periods B and C occurs. During period D all smart sensor interfaces on the bus increment their counters by one and the interface whose address is 2, which in the example is a digital interface 50, connects bus wire 70 to ground to signal that it is present. During period E the addressed smart sensor interface connects bus wire 70 to its associated sensor. In this example, the switch is closed so a large current is drawn from current mirror 26.

Analog smart sensor interface 60 is addressed during time periods F and G. As before, during period F all smart sensor interfaces on the bus increment their counters. This time the counters are incremented to 3 and analog smart sensor interface 60 is activated. During period F analog smart sensor interface 60 activates its transmission gate 66 thus connecting bus wire 70 to ground. Microcontroller 10 reads the voltage drop across conversion resistor 12 at approximately the midpoint of time period F and if a large voltage is read is able to infer that the addressed smart sensor interface 60 is present on the multiplex bus and functioning. During period G microcontroller 10 places 6 volts on the multiplex bus and analog smart sensor interface 60 connects bus wire 70 to its associated analog sensor resistor 69. Thus a current flows through current mirror 26 which is related to the resistance of analog sensor resistor 69. This current can be high or low, and at values in between, depending on the resistance of analog sensor resistor 69. That is, a variable analog parameter is being sensed. At approximately the midpoint of period G, microcontroller 10 reads the voltage present across conversion resistor 12 and saves the number in a program variable called Vsense.

At this point microcontroller 10 has enough information to compute the actual resistance value of analog sensor resistor 69 based on the following known or measured program variables or constants:

Rcal—the known value of calibration resistor 14 in ohms. This value can be an engineering value if resistors of sufficiently high tolerance, e.g. 1%, are used or it can be the measured resistance of the actual component used in the circuit. This value can be stored in a read only memory of the microcontroller.

Vcal—the voltage measured during time period AA. This program variable in conjunction with Rcal allows the control program to remove inaccuracies in the measured value of Vsense which are due to components in D/R 20 where most of the component variation occurs.

Vbase—the voltage measured during time period A. This program variable allows the control program to remove the contribution of the power supply currents of all of the smart sensor interface circuits from the measured value of Vsense.

Vsense—the voltage measured during the read phase of an addressed analog smart sensor interface, in the example during time period G.

Microcontroller 10 computes a resistance value, Rsense, corresponding to the status of the analog sensor as represented by resistor 69 by using the following formula:

$$Rsense=Rcal*Vcal/(Vsense-Vbase)$$

Rsense can be the actual resistance value of a resistance type analog sensor or a resistance equivalent of the parameter measured by another type of analog sensor. Based on the computed value of Rsense, microcontroller 10 determines the actual measured parameter, e.g. gallons of fuel, pressure, etc., by means of a formula or look-up table. This value can be displayed or used to cause the microcontroller to take further action, for example, issuing a command to turn on one of the motors 18 or 19.

Microcontroller 10 proceeds to issue minor cycle commands, for example, during periods H–I, J–K, etc. until all of the smart sensor interfaces have been addressed. The microcontroller then begins a new major cycle by repeating steps AA and A. Thus, in the preferred embodiment being described major cycles begin every 32 milliseconds.

Figure 4:
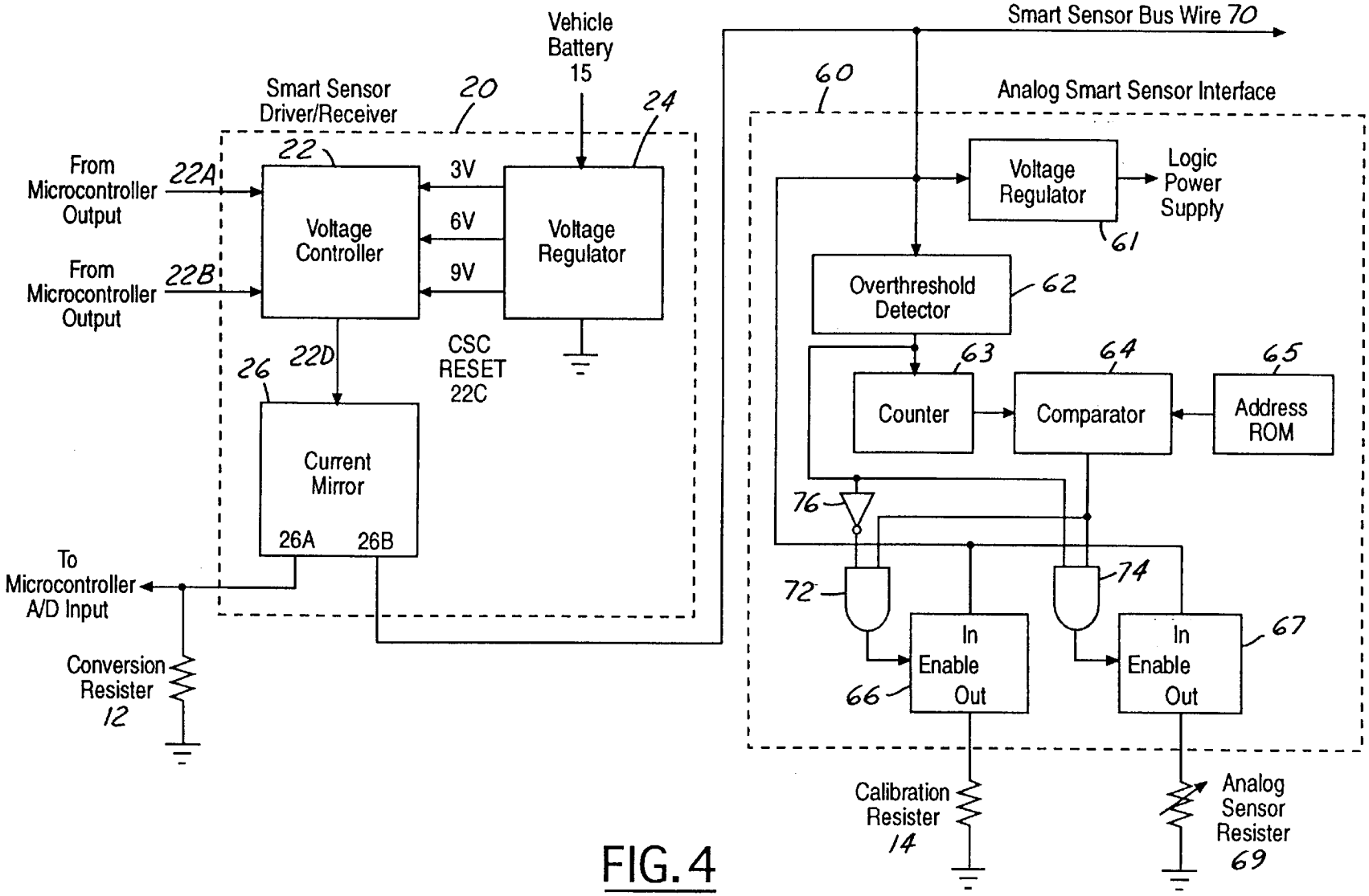
FIG. 4 is a block diagram similar to FIG. 2 showing a circuit modification with increased accuracy in measuring analog quantities.

FIG. 4 shows an alternate embodiment of the invention that affords increased precision. Similar components as used in the circuits previously described have the same reference numbers. The waveforms for the circuit of FIG. 4 are the same as shown in FIG. 3. The principal change to the circuit of FIG. 1 is that the calibration resistor is moved from D/R 20 to the analog smart sensor interface 60. Thus there must be a calibration resistor at each analog smart sensor interface present in the system. Table 3 below shows the voltages at the output 22D of the voltage controller 22 in response to the logic control input signals from the microcontroller at the inputs 22A and 22B.

TABLE 3

| 22A | 22B | VOLTAGE OUTPUT |
|---|---|---|
| 0 | 0 | 0 |
| 0 | 1 | 6 |
| 1 | 0 | 3 |
| 1 | 1 | 9 |

Referring to FIG. 3, at time AA microcontroller 10 sets the voltage controller inputs 22A and 22B to logic 0 which, according to Table 3 above, causes a zero voltage on bus wire 70 and in turn causes all smart sensor interfaces attached to bus wire 70 to reset their counters 63. The system operation during periods A through E are the same as previously described. At the beginning of time period F microprocessor 10 asserts a logic 1 on both voltage controller 22 inputs 22A and 22B causing 9 volts to be put on bus wire 70. As before, this causes all of the smart sensor interfaces 50, 60 to increment their counters and analog sensor interface 60 is addressed so it enables transmission gate 66. This allows current to flow from bus wire 70 through transmission gate 66 and calibration resistor 14 to ground. At about the middle of time period F the microcontroller 10 reads the voltage across calibration resistor 14, produced by the copy of the current from current mirror 26, and stores it as the program variable called Vcal. The microcontroller can also use this voltage to see if the analog smart sensor interface is present on the bus.

The system operation during period G is the same as that described in the first embodiment except that microcontroller 10 uses a slightly different equation to compute Rsense:

$$Rsense=Rcal*Vcal*6/9/(Vsense-Vbase)$$

The extra factor of (6/9) comes from the fact that the calibration current is measured when the 9V address voltage (instead of the 6V sense voltage as in the previously described embodiment) is on bus wire 70. If the voltage produced by voltage regulator 24 is not sufficiently accurate then the A/D converter of microcontroller 10 can be used to read the actual values of Vaddress and Vread. In this case the term (Vread/Vaddress) should be used instead of (6/9).

The system operation during periods H through P are the same as in the prior embodiment.

As seen, a novel circuit is provided wherein the status of a plurality of sensors, including at least one analog sensor can all be connected to and monitored from a single wire bus line in a multiplex configuration. The circuit is relatively inexpensive to construct and easy to implement in an application such as an automobile, since only a single wire is required.

What is claimed is:

1. A monitoring circuit for a line bus having at least one analog sensor connected thereto, comprising:

a microcontroller, said microcontroller polling the analog sensor with a voltage over said bus, said at least one analog sensor producing a current on said bus representative of its status in response to said polling voltage; and a measuring circuit, said measuring circuit being responsive to said current of said bus producing by said at least one analog sensor and determining the status of said at least one analog sensor producing said current on the basis of said current the measuring circuit including:

a current mirror circuit which monitors and generates a current replica of said current produced on said bus; and a conversion resistor for receiving said current replica.

2. A monitoring circuit as in claim 1 wherein said measuring circuit further comprises a computer for converting a voltage developed across said conversion resistor in response to receipt of said current replica into a value corresponding to the status of said at least one analog sensor polled by said polling voltage.

3. A monitoring circuit as in claim 1 further comprising:

a plurality of sensor interface circuits connected to said bus, each interface circuit establishing a communication path between a respective sensor connected to a said sensor interface and said bus, each said sensor interface being selectively addressable by said microcontroller to enable an analog sensor associated therewith to be connected to said bus to receive said polling voltage and produce a current on said bus.

4. A monitoring circuit as in claim 3 wherein each said interface circuit contains an address counter which determines the current address of the interface being polled by such microcontroller, and said microcontroller operates to reset the counters of said plurality of sensor interfaces at the beginning of a cycle of polling sensors by selectively addressing said plurality of sensor interfaces.

5. A monitoring circuit as in claim 3 further comprising a digital type sensor associated with at least one of said sensor interfaces, a said digital type sensor having an "on" state and an "off" state.

6. A monitoring circuit as in claim 5 wherein said at least one digital type sensor, when in said "on" state, produces a current on said bus in response to said polling voltage.

7. A monitoring circuit as in claim 3 wherein said polling voltage is supplied to an addressed sensor interface in two stages, a first stage to produce a current on said bus to indicate the presence or absence of a sensor at the addressed sensor interface and a second stage to produce a current on said bus corresponding to the status of the sensor associated with the addressed interface.

8. A monitoring circuit as in claim 7 further comprising a driver circuit operated by said microcontroller said driver circuit producing polling voltages of a first level and a second level in response to said microcontroller to perform said two polling stages of an addressed sensor interface.

9. A monitoring circuit as in claim 8 wherein, each said interface circuit contains an address counter which determines the current address of the interface being polled by said microcontroller, and wherein said driver circuit is operated by said microcontroller to produces a voltage of a third level to reset the counters of said plurality of sensor interfaces at the beginning of a cycle of selectively addressing each of said plurality of sensor interfaces with said polling voltage.

10. A monitoring circuit as in claim 3 further comprising:

a driver circuit operated by said microcontroller, said driver circuit supplying a voltage to said bus and all of the connected sensor interfaces to produce a calibration current on said bus;

a resistor having a value Rcal to receive a said current replica of said calibration current to produce a voltage Vcal in response thereto; and wherein a voltage Vsense is produced by said conversion resistor having passed therethrough said current replica corresponding to the status of the sensor receiving said polling voltage at an addressed sensor interface; and a computer arranged to convert the voltages Vsense and Vcal into a value corresponding to the status of the sensor at the addressed sensor interface.

11. A monitoring circuit as in claim 10 wherein said computer is said microcontroller.

12. A monitoring circuit as in claim 10 wherein each of said plurality of sensor interfaces operates from a power supply, one of said conversion resistor and resistor of value Rcal receiving from said current mirror circuit a current replica of the current of the power supply of an addressed sensor interface on said bus to produce a voltage Vcal, said computer converting the voltages Vsense, Vcal and Vbase into a value corresponding to the status of the sensor receiving said polling voltage at the addressed sensor interface.

13. A monitoring circuit as in claim 11 wherein the status of a sensor receiving said polling voltage at an addressed sensor interface is represented by a resistance value Rsense, and said computer calculates Rsense according to the equation $$Rsense=Rcal*(Vcal/(Vsense-Vbase)).$$

14. A monitoring circuit as in claim 12 wherein each said sensor interface includes a resistor of value Rcal with said voltage Vcal being produced across said resistor Rcal of the addressed sensor interface.

15. A monitoring circuit as in claim 14 wherein a sensor at an addressed sensor interface receives a voltage of a first level "x" to produce the current on said bus corresponding to sensor status and said voltage polling the entire monitoring circuit to produce said current representative of the current flowing through the entire monitoring circuit is of a second level "y" greater than "x", and said computer calculates Rsense according to the equation $$Rsense=Rcal*(x/y*Vcal/(Vsense-Vbase)).$$

16. A monitoring circuit for a bus having an analog sensor connected thereto, comprising:

a microcontroller, said microcontroller polling the analog sensor over said bus with a voltage, said analog sensor producing a current on said bus representative of its status in response to the received polling voltage;

a current mirror circuit which monitors and produces a current replica of said current on said bus;

a conversion resistor which is arranged to receive said current replica and produces a voltage when said current replica passes therethrough; and a computer, said computer converts said voltage produced by said conversion resistor into a value corresponding to the status of said analog sensor.

17. A monitoring circuit as in claim 16 further comprising:

a sensor interface circuit which connects said analog sensor to said bus;

a driver circuit operated by said microcontroller, said driver circuit supplies a voltage to said bus and said sensor interface to produce a calibration current on said bus;

a resistor having a value Rcal arranged to receive a current replica of said calibration current from said current mirror circuit and to produce a voltage Vcal in response thereto; and wherein a voltage Vsense is produced by said conversion resistor in response to the passing therethrough of said current replica corresponding to the status of said analog sensor and said computer converts the voltages Vsense and Vcal into a value corresponding to the status of said analog sensor.

* * * * *